United States Patent [19]

LaBorde et al.

[11] 4,266,605

[45] May 12, 1981

[54] WIRELINE SAFETY CHECK VALVE

[76] Inventors: Russel G. LaBorde, 4055 N. Stowell Ave., Shorewood, Wis. 53211; Emmett F. Brieger, Bonito Rte., Nogal, N. Mex. 88341

[21] Appl. No.: 144,644

[22] Filed: Apr. 28, 1980

[51] Int. Cl.[3] ..... E21B 34/04; E21B 43/00

[52] U.S. Cl. ..... 166/97; 166/329; 137/519.5

[58] Field of Search ..... 166/97, 77, 91, 329, 166/328, 319, 325; 137/519.5, 498

[56] References Cited

U.S. PATENT DOCUMENTS

| | | | |
|---|---|---|---|
| 2,376,605 | 5/1945 | Lawrence | 166/125 |
| 3,424,247 | 1/1969 | Lee | 166/329 |
| 3,532,163 | 10/1970 | Ecuer | 166/53 |

*Primary Examiner*—Stephen J. Novosad

*Attorney, Agent, or Firm*—Weber, Raithel, Malm & LaFave

[57] ABSTRACT

A check valve for wireline operations is employed in oil well drilling where a high pressure is encountered in a well. The check valve permits a wireline to extend through the check valve and a ball chamber therein. The ball chamber has a check ball therein that rests between the wireline and a non restrictive flow passage open to the well, so that upon loss of the wireline the fluid or gas tending to escape forces the ball to block the wireline opening.

4 Claims, 2 Drawing Figures

WIRELINE SAFETY CHECK VALVE

BACKGROUND

In oil well drilling and production wireline services are employed to raise, lower and operate tooling in a well. In wells where high pressure fluids or gases are encountered, it is desirable to employ a safety check valve which operates automatically upon loss of wireline, to thus protect well head apparatus and prevent escape of fluid or gas from the well. Other safety devices such as a blowout preventer may then be closed.

SUMMARY

The invention relates to a ball type check valve assembly permitting a wireline to extend therethrough for use with well head piping apparatus, for wells in which the high pressure encountered may exceed 5000 psi. The check valve assembly comprises a valve housing having a cylindrical bore with a first check valve and a second or auxiliary check valve fitted within the bore of the housing and axially aligned and abutting each other. The first check valve at its wireline passage forms the valve seat for the second check valve.

The first check valve has a transverse bore in which a ball check rests adjacent to a wireline passage, and parallel thereto it has a non restrictive flow passage that is open to the transverse passage behind the ball and open to the well. The structure for the wireline passage provides a valve seat facing within the transverse bore. Thus when the wireline is removed when the check valve is subject to high pressure or high velocity flow of fluid or gas from the well, such fluid or gas acts directly on the ball to force it upon the valve seat and block escape of fluid or gas through the first check valve.

The second or auxiliary check valve which is below the first check valve may similarly be activated to momentarily block the wireline passage and increase the differential pressure on the ball of the first check valve to assist its closing, and then the second or auxiliary check valve opens.

The check valves comprise cylindrical inserts and check balls that are readily removable from the valve housing. The valve seats, which have a wireline passage therethrough, are each also readily removable from the insert for repair or replacement. Valve seats may be provided to accommodate different sizes of wirelines.

OBJECTS

It is an object of the invention to provide a wireline safety check valve for high pressures and utilizing a check ball that is acted upon directly by fluid or gas tending to escape from a well when the wireline is removed.

Another object of the invention is to provide a check valve as an insert into a valve housing that is easily removable therefrom, and that has no moving parts except the ball that serves as the ball check.

Another object of the invention is to provide an auxiliary check valve also as a valve insert that cooperates with the insert of the first check valve, and is momentarily operable to assist the first check valve to close.

THE DRAWINGS

Figure 1:
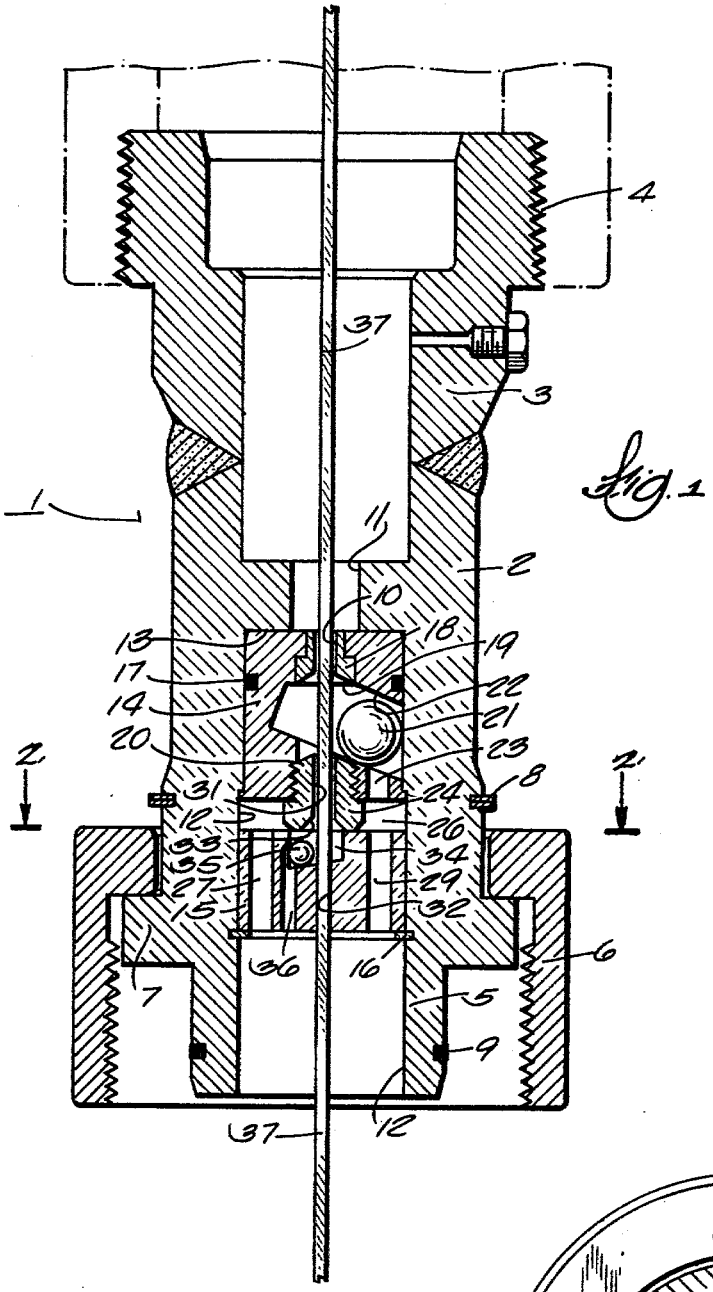
Figure 2:
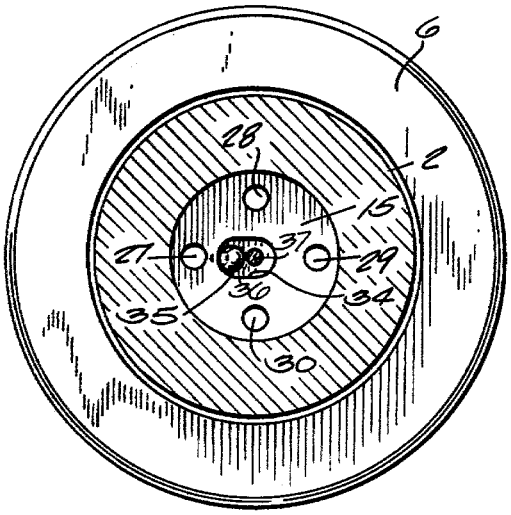

FIG. 1 of the drawing is a sectional view in elevation of a wireline extending therethrough, as employed in well head apparatus but not showing the well head apparatus to which it is coupled; and FIG. 2 is a plan view taken along the line 2-2 in FIG. 1, of the spacer insert which forms part of the second or auxiliary check valve.

DESCRIPTION

With reference to the drawings, the wireline safety check valve 1 is an assembly which comprises a valve body 2 which at its upper end is welded to a box connector 3. The box connector 3 provides a male threaded end 4 for coupling in well head apparatus (not shown). The lower end 5 of the body 2 of the check valve assembly telescopes into adjacent piping (not shown) of well head apparatus having an external threaded end which is coupled to female threaded coupling 6 on the valve body 2. The female coupling 6 is retained between a shoulder 7 and a retainer ring 8 on the valve body 2. Annular sealing means 9, comprising an O-ring and back up ring, is provided in a groove in the periphery of the end 5 of the valve body to make sealing engagement with the wall of the piping in which it telescopes and to which it is coupled.

The valve body 2 has a bore 11 near its upper end and a larger bore 12 which extends from its bottom end to the smaller bore 11, which together define a shoulder 13 therebetween. The larger bore 12 provides a cylindrical chamber for receiving cartridge valve inserts 14, 15 axially in line with one another, with valve insert 14 abutting the shoulder 13 and valve insert 15 abutting valve insert 14, with valve insert 15 secured by a retainer ring 16 disposed in an annular groove in the wall of the bore 12. The first insert 14 has an annular groove about its periphery with an O-ring and back-up ring therein providing sealing means 17 in engagement with the wall of the bore 12.

A first insert cartridge comprises the first valve insert 14 and the elements contained therein. The valve insert 14 has stepped bores at its upper end with a bored valve plug 18 fitted therein and a passage 10 for a wireline 37 therethrough. The valve plug 18 has a tapered bottom end defining a valve seat 19. The valve plug 18 is disposed in position through a threaded bore 25 at the lower end of the valve insert 14, and a wireline guide plug 20 is threaded into the bore 25. The guide plug 20 has a coaxial bore 31 for a wireline passage, and its bore 31 provides close clearance on the order of 0.003 to 0.005 inch with the wireline, whereas the bore 10 in the valve plug 18 provides greater tolerance on the order of 0.030 inch for the wireline.

The valve seat 19 of valve plug 18 is concavely tapered for tangential seating contact with a check ball 21. A transverse bore 22 extends laterally from one side of valve insert 14 to a distance beyond the valve plug 18 and its valve seat 18 so the ball 21 can freely seat thereon. The guide plug 20 extends inward to the transverse bore and the guide plug has a convex shaped upper end tangentially aligned with the bottom side of the transverse bore 22, which is inclined so that the check ball 21 will roll therein and normally rest against the wall of the bore 12 in the valve body 2. For a check ball 21 of 1 inch diameter, the transverse bore 22 has a diameter of 1.010 inches, defining a loose fit for ball 21.

The first valve insert 14 has a vertical passage 23 which is parallel to the wireline passage 10 and provides a non restrictive passage for the flow of well fluid or gases. The vertical passage 23 is open to the bottom end of the valve insert and extends upward to open into the transverse bore 22 behind the check ball 21 in its normal ıt rest position shown in FIG. 1.

The wireline guide plug 20 in valve insert 14 has a nut shaped head 24 that has a concavely tapered coaxial opening to the wireline passage 31 which serves as a valve seat 33 for the abutting second valve cartridge comprising valve insert 15.

The second valve cartridge and its valve insert 15 cooperate with the first valve cartridge and its valve insert 14 to serve as a spacer, as an additional wireline guide, and as an auxiliary check valve. Valve insert 15 abuts the head of the wireline guide plug 20 to define a space 26 about the plug 20 and between the first valve insert 14 and the second valve insert 15.

Valve insert 15 has a plurality of axial circumferentially spaced passages 27, 28, 29, 30 formed by drilled holes therethrough or by axial slots in the periphery of the valve insert 15, each of which permits non restrictive flow of well fluids or gases. A wireline passage 32 extends coaxially through the valve insert 15.

The top of the valve insert 15 has a chamber 34 recessed therein and generally centrally located, as shown in FIGS. 1 and 2, which is open to the wireline passages 31 and 32. The periphery of the recess chamber 34 abuts the end surface of the head 24 of the guide plug 20. The bottom surface of the recess chamber is inclined downward to the left, and a check ball 35 is very loosely fitted in the recess chamber 34. The check ball 35 is larger than the openings for the wireline passages 31, 32. An axial bore 36, located radially inward of axial bore 27, opens to the side and to the bottom of the recess chamber 34, at its downwardly inclined end where the auxiliary check ball 35 normally rests. The recess chamber 34 is open via bore 36 to the well, so that when there is flow of well fluid or gas therethrough it will tend to seat the ball 35 on the valve seat 33 provided by the guide plug 20.

When the wireline 37 is employed in a well under high pressure and is accidentally lost or removed from the check valve assembly, high pressure in the well will force well fluid or gas to tend to exit through the vacated wireline passages 10, 31, 32, and also through the other passages 27, 28, 29, and 30 to space 26 and thence through passage 23 to transverse bore 22 to wireline passage 10. The flow to the transverse bore 22 is less restrictive than through the wireline passages 32, 31, and results in a differential pressure on the first check ball 21 forcing it to be displaced to the check position on the valve seat 19, blocking all flow through the wireline passage 10.

The auxiliary check valve functions in a similar manner if the first check valve has not closed. Turbulent flow into recess chamber 34 through bore 36 displaces the small check ball 35 until it lodges on the valve seat 33 of the guide plug 20. This blocks wireline passage 31 and drops the pressure ahead of the ball check 21 in transverse bore 22. The differential pressure acting behind the ball check 21 is thus increased to force the ball check 21 to closed position on the valve seat 19. When this occurs there is no differential pressure nor flow acting any longer upon the auxiliary or smaller ball 35 and it falls to its normal rest position.

What is claimed is:

1. A wire line safety check valve for a well, said check valve comprising a valve body having a stepped axial bore therethrough, a valve insert fitted in said stepped bore in abutment with a shoulder thereof, said valve insert having a stepped axial bore therethrough, a first valve seat secured in the upper end of the bore in said valve insert and having a wire line passage, a ball, an inclined bore in said valve insert from one side thereof fitted with said ball normally biased by its weight to fall away from said valve seat and toward said valve body, a guideline insert with a wireline passage secured in the lower end of the axial bore in said valve insert, and a longitudinal bore in said valve insert that is open at its bottom end for unrestricted communication with the well casing and open at is upper end to the inclined bore at an area behind the ball, a wireline extends through the wireline passages of the check valve and normally restricts the passage of fluid therethrough;

whereby upon loss or removal of said wireline, fluid under pressure in said well surges upward and forces said ball to abut said valve seat and close the opening thereof.

2. A wireline safety check valve for use in well head apparatus for a well having high pressure fluid or gases and for use with a wireline that extends through said check valve;

said check valve comprising an axial wireline passage for the wireline which prevents the flow of well fluid therethrough, a pair of axially spaced valve chambers each open to said wireline passage, another axial passage having less flow restriction than said wireline passage and is open to both of said valve chambers and to said well below said check valve, and movable check means disposed in each of said valve chambers between said wireline passage and said another passage;

upon the wireline being removed from said check valve the flow of well fluid or gas tending to escape results in a differential pressure acting directly on said check means to urge said check means to close said wireline passage, and said check means in a lower one of said valve chambers when in closed position causes an increase in differential pressure on said check means in an upper one of said valve chambers to assure the closing of the wireline passage therein.

3. A wire line check valve with a valve member having a main check and an auxiliary check to assure operation of the main check in the event that a wire line that extends through the check valve is removed, said valve member having a relatively small diameter passage centrally therethrough for the passage of a wire line which normally prevents passage of well fluid, an upper valve seat and a lower valve seat, a first chamber between said valve seats with a relatively large ball therein adapted to be urged on the upper valve seat formed to mate therewith, a second chamber below said lower valve seat with a relatively small ball therein adapted to be urged on the lower valve seat formed to mate therewith, and non-restrictive flow passages open respectively to both said ball chambers behind said large ball and said small ball.

4. A safety check valve for wireline operations in a well in which fluids or gases may develop high pressures tending to force the fluids or gases upward through the check valve and toward the well head, a wireline is extended through said check valve that restricts flow of pressure fluid or gases during wireline operations and said check valve is operable to close said check valve when said wireline is removed, said safety check valve comprising a valve body having a cylindrical chamber with first and second cylindrical valve inserts axially aligned and secured therein; said first valve insert having a central bore with two valve seats coaxially secured therein and each has a central passage of relatively small diameter for the wireline, one valve seat is at the upper end of the first valve insert and its seat faces downward in the bore, and the other valve seat is at the lower end of the first valve insert and its seat also faces downward of the bore, and said first valve insert has an inclined transverse bore that extends from one side through the central bore and has a longitudinal bore of relatively large diameter along one side that extends from the bottom thereof into the lower end of the transverse bore, a ball is fitted in said transverse bore and tends to fall away from the first valve seat, whereby pressure fluid is admitted through the longitudinal bore into the transverse bore behind the ball to force it on the first valve seat when the wireline is removed, said second valve insert abuts the end of the second valve seat, a plurality of circumferentially spaced passages extend longitudinally through said second valve insert to interconnect the well space below the second valve insert with the transverse bore behind the large ball, a recessed area in the upper end of the second valve insert adjacent the wireline passage through the second valve seat, a small ball is disposed in the recessed area that is open to fluid in the well that acts on the small ball to force it on the second valve seat when the wireline is removed until the first ball has seated.

* * * * *